US006484910B1

(12) United States Patent
Korkos

(10) Patent No.: US 6,484,910 B1
(45) Date of Patent: Nov. 26, 2002

(54) BRACELET FASTENING TOOL AND METHOD OF USE

(76) Inventor: John S. Korkos, 2455 Martha Dr., Lake Wales, FL (US) 33853

( * ) Notice: Subject to any disclaimer, the term of this patent is extended or adjusted under 35 U.S.C. 154(b) by 0 days.

(21) Appl. No.: 09/966,913

(22) Filed: Oct. 1, 2001

(51) Int. Cl.[7] ..... A47G 25/80
(52) U.S. Cl. ..... 223/111; 223/DIG. 2
(58) Field of Search ..... 223/111, DIG. 2

(56) References Cited

U.S. PATENT DOCUMENTS 3,016,589 A * 1/1962 Collins ..... 24/3

* cited by examiner

*Primary Examiner*—John J. Calvert
*Assistant Examiner*—James G Smith
(74) *Attorney, Agent, or Firm*—George A. Bode; Lisa D. Velez; Bode & Associates

(57) ABSTRACT

A bracelet fastening tool comprising a band which fits around the wrist of a user and a resilient, bracelet-securing bracket coupled to the band. The resilient, bracelet-securing bracket comprises a bracelet docking pad having a width which is wider than the width of the band wherein one side of the bracelet docking pad radiates from the band and tapers and arcs to form a hooking implement. Holes are formed in the other side of said bracelet docking pad. A resilient strapping member is tied to the holes and is adapted to hook onto the hooking implement across the bracelet docking pad to secure the bracelet. The band may be elastic or an open-ended or C-shaped spring band made of a flexible metal.

16 Claims, 2 Drawing Sheets

BRACELET FASTENING TOOL AND METHOD OF USE

BACKGROUND OF THE INVENTION

1. Field of the Invention

The present invention relates to bracelet fastening tools and, more particularly, to a bracelet fastening tool which includes a bracket with a resilient strapping member adapted to be hooked to the bracket to firmly secures one end of a bracelet in place.

2. General Background

Bracelets, watches and other wrist-worn apparel are generally cumbersome to attach, especially, for the elderly or those having arthritis in their hands. The primary difficulty resides in the inability of the user to manipulate the bracelet, with one hand whether dominant or non-dominant, to hold the bracelet in place about the wrist and manipulate the ends of the bracelet to clasp them together.

Several devices have been patented which are aimed at bracelet fastening tools.

For example., U.S. Pat. No. 5,934,526, issued to Rosenbaum et al., entitled "DEVICE FOR FACILITATING MANIPULATION OF JEWELRY CLASPS" discloses a device for facilitating the manipulation and fastening of a bracelet comprising an elastic strap or band for encircling the wrist of the user. The strap has a coupling which is connected to an alligator clip or spring clamp for releasably holding the clasp at one end of the bracelet to allow the user to use their free hand to hook the eyelet at the other end of the bracelet into the opened clasp.

U.S. Pat. No. 5,899,369, issued to Macripo, entitled "BRACELET CLOSURE AID" discloses a closure aid for a bracelet comprising a band with a hook and loop (or VELCRO) fasteners at the opposing ends for encircling the wrist of the user. The band has a hook and loop folder attached thereto by stitching. The folder has pages which folder over and fasten to hold one end of the bracelet to allow the user to use their free hand to hook opposing ends of the bracelet together.

U.S. Pat. No. 5,785,217, issued to Gorham, Jr., entitled "WRIST-WEAR ATTACHMENT DEVICE AND METHOD OF USE" discloses a wrist-wear attachment device comprising an ellipsoidal-shaped receiving member that is adapted to fit in the palm of the user's hand. The ellipsoidal-shaped receiving member has a palm-accommodating portion and integral wrist-accommodating portion each having attached thereto a hook and loop fastener. The hook and loop fastener folds over to hold the clasp provided at one end of the bracelet to allow the user to use their free hand to hook the opposing end of the bracelet together.

Other patent in the art include U.S. Pat. No. 6,036,065, issued to Wofford et al., entitled "JEWELRY INSTALLATION DEVICE"; U.S. Pat. No. 5,709,327, issued to LaMacchia et al., entitled "BRACELET FASTENING DEVICE"; U.S. Pat. No. 6,112,958, issued to LaMacchia et al., entitled "COMBINATION BRACELET FASTENER, BUTTON HOOK AND ZIPPER PULL"; U.S. Pat. No. 5,405,066, issued to Fakier, entitled "BRACELET FASTENER HELPER"; U.S. Pat. No. Des. 323,132, issued to Grennan, entitled "BRACELET FASTENING TOOL" none of which meets the needs of the present invention.

As will be seen more fully below, the present invention is substantially different in structure, methodology and approach from that of the prior bracelet fastening tools.

SUMMARY OF THE PRESENT INVENTION

The preferred embodiment of bracelet fastening tool of the present invention solves the aforementioned problems in a straight forward and simple manner.

Broadly, the present invention contemplates a bracelet fastening tool comprising: a band which fits around the wrist of a user; and, a resilient, bracelet-securing bracket coupled to the band. The resilient, bracelet-securing bracket comprises: a bracelet docking pad having a width which is wider than the width of the band wherein one side of the bracelet docking pad radiates from the band and tapers and arcs to form a hooking implement; means for securing the bracelet docking pad to the band; at least one hole formed in the other side of said bracelet docking pad; and, a resilient strapping member tied to said at least one hole and which is adapted to hook onto the hooking implement across the bracelet docking pad to secure the bracelet placed thereon.

The present invention contemplates a bracelet fastening tool having an open-ended or C-shaped spring band made of a flexible metal and which is spring adjusted to accommodate for a variety of wrist sizes. Alternately, the band may be elastic.

Additionally, the present invention contemplates a method of fastening a bracelet with a bracelet fastening tool comprising a resilient, bracelet-securing bracket and an open-ended or C-shaped spring band, the method comprising the steps of:

(a) placing the open-ended or C-shaped spring band around a user's wrist, the band having two ends;

(b) overlaying the bracelet on top of the band;

(c) simultaneous with the step (b), placing one end of the bracelet in a bracelet docking pad of said resilient, bracelet-securing bracket;

(d) looping a resilient strap, of said resilient, bracelet-securing bracket, having a resilient loop over the bracelet and the bracelet docking pad and onto a hooking implement integrated with said bracelet docking pad; and, (e) with a free hand of the user, hooking an opposing end of the bracelet with said one end of the bracelet.

In view of the above, an object of the present invention is to provide a bracelet fastening tool with a resilient strapping member which includes a resilient loop secured to at least one hole; and, means for pulling the loop across said bracelet docking pad and over the hooking implement.

In view of the above, a feature of the present invention is to provide a bracelet fastening tool which is simple to use.

Another feature of the present invention is to provide a bracelet fastening tool which is relatively simple structurally and thus simple to manufacture.

A further feature of the present invention is to provide a bracelet fastening tools which assists the user to fasten the bracelet without damaging or forming nicks or other imperfections in the bracelet's surface.

The above and other objects and features of the present invention will become apparent from the drawings, the description given herein, and the appended claims.

BRIEF DESCRIPTION OF THE DRAWING

For a further understanding of the nature and objects of the present invention, reference should be had to the following description taken in conjunction with the accompanying drawings in which like parts are given like reference numerals and, wherein.

DETAILED DESCRIPTION OF THE PREFERRED EMBODIMENT

Figure 1:
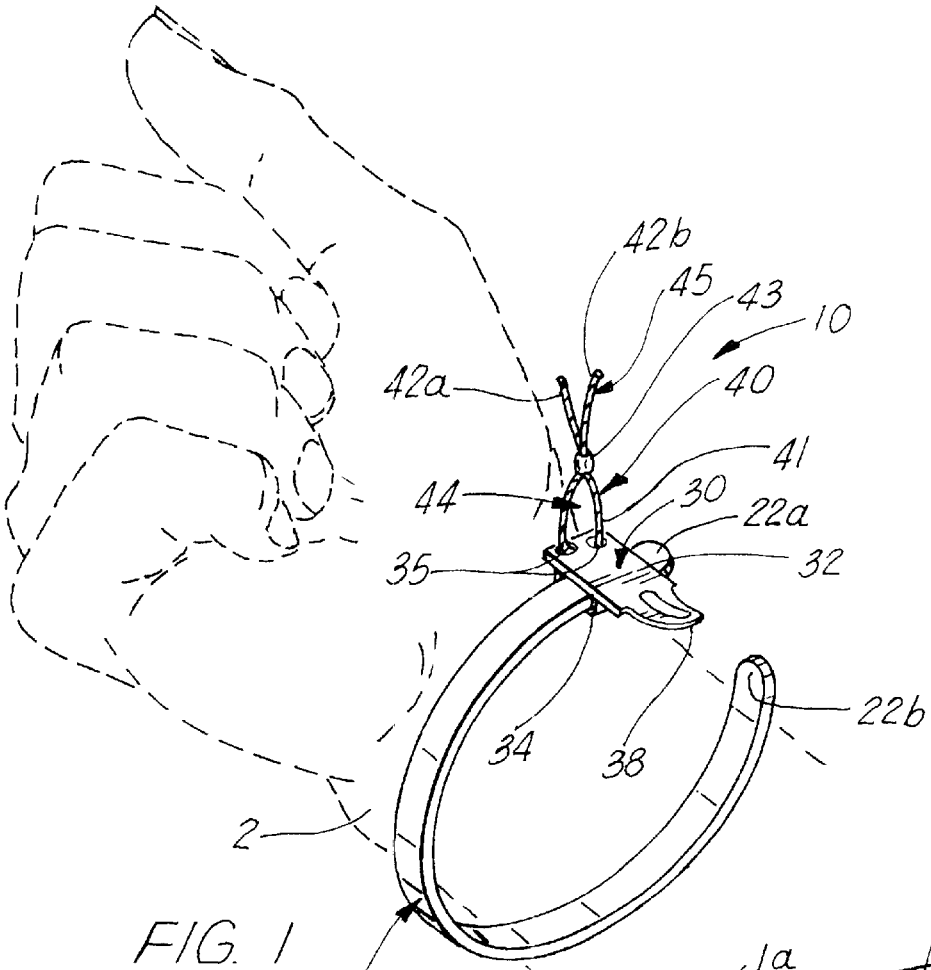
FIG. 1 illustrates a perspective view of the bracelet fastening tool of the present invention worn about a user's wrist (shown in phantom)
Figure 2:
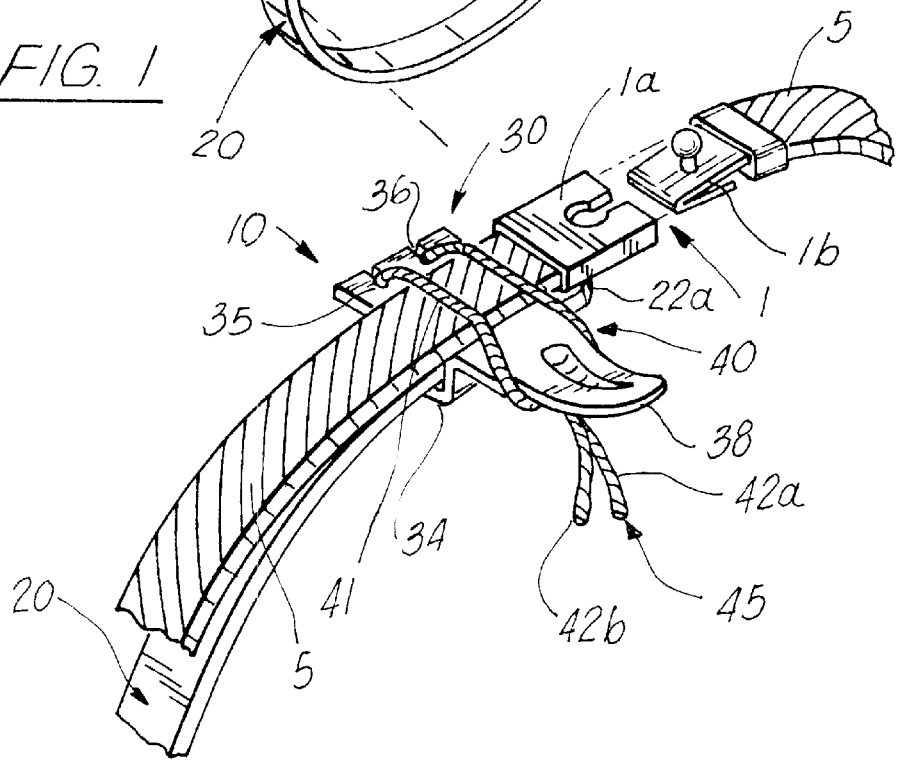
FIG. 2 illustrates a partial view of the bracelet fastening tool of the embodiment of FIG. 1 in use to hold one end of a bracelet; and, FIG. 3 illustrates a perspective view of an alternate embodiment of the bracelet fastening tool of the present invention.

Referring now to the drawings and in particular FIGS. 1–2, the bracelet fastening tool of the present invention of the present invention is generally referenced by the numeral 10. The bracelet fastening tool 10 is generally comprised of an open-ended or C-shaped spring band 20 which fits around the wrist of a user and a resilient, bracelet-securing bracket 30 coupled to the band 20 near one end 22*a* thereof.

In the exemplary embodiment, the open-ended or C-shaped spring band 20 is made of a flexible metal which allows the open-ended or C-shaped spring band 20 to be adjusted to the user's wrist 2 and which has sufficient structural rigidity to maintain the adjusted shape. The open-ended or C-shaped spring band 20 may be adjusted so that the ends 22*a* and 22*b* become farther apart before placing the band 20 on the wrist 2 and nearer thereafter. Alternately, the spring properties of the open-ended or C-shaped spring band 20 allows the ends 22*a* and 22*b* of the band 20 to be automatically stretched opened to accommodate the size of the wrist 2 when slipping the band 20 about the wrist 2. Thus, the open-ended or C-shaped spring band 20 is quick and easy to place about the wrist 2 and adjust.

The resilient, bracelet-securing bracket 30 includes a bracelet docking pad 32 and a securing means 34 for securing the bracelet docking pad 32 to the band 20. The bracelet docking pad 32 has a width which is wider than the width of the band 20 wherein one side has at least one hole 35 formed therein for tying or securing thereto a resilient strapping member 40. The other side of the bracelet docking pad 32 radiates from the side of the band 20 and tapers and arcs upward to form a hooking implement 38 for hooking the resilient strapping member 40 across the bracelet docking pad 32 to secure the bracelet 5 in the bracelet docking pad 32.

In the exemplary embodiment, the securing means 34 for securing the bracelet docking pad 32 includes a U-shaped member affixed to the underside of the bracelet docking pad 32 to form a channel guide dimensioned to receive or friction-fit couple therethrough the band 20. In an alternate embodiment, the securing means 34 may only include welding provided both the bracelet docking pad 32 and the band 20 are made of metal material. A still further embodiment will be described in detail with regard to FIG. 3.

In the exemplary embodiment, the at least one hole 35 includes two spaced apart holes. The resilient strapping member 40 includes an elastic, stretchable or rubberized cord 41 looped through the holes 35. The edge of said one side of bracelet docking pad 32 has two slits 36 wherein a respective one of the slits 36 extends into a holes 35. The elastic, stretchable or rubberized cord 41 can be snapped through the slits 36 and into the holes 35 wherein a portion of the cord 41 extends below the bracelet docking pad 32 between the holes 35.

The free ends 42*a* and 42*b* of the resilient strapping member 40 are tied or secured together to create a resilient loop 44 and a depending handle means 45. The handle means 45 is defined by the length of the ends 42*a* and 42*b* of elastic, stretchable or rubberized cord 41 which extend beyond the tied knot 43 or other means to form the resilient loop 44. Alternately, in lieu of the illustrated handle means 45, a tab, eyelet or other structure suitable for grasping with fingers and which can be coupled to the resilient loop 44 can be substituted.

The handle means 45 is pulled on by the user to stretch the resilient loop 44 of the resilient strapping member 40 over the hooking implement 38. When the handle means 45 is released, the resilient loop 44 is secured around the hooking implement 38. When the bracelet 5 is positioned in the bracelet docking pad 32, the resilient properties of the resilient strapping member 40 resiliently flexes the resilient loop 44 to conform to the bracelet's profile so that nick or other scratches and imperfections are not formed in the bracelet's surface.

Referring now to FIG. 2, the method of use will be described in detail. In operation, the user places the open-ended or C-shaped spring band 20 around their wrist 2. Thereafter, the bracelet 5 or other wrist-worn apparel is overlaid on top of the band 20 and placed in the bracelet docking pad 32. As the bracelet 5 is overlaid, one end of the clasping mechanism 1 of the bracelet 5 is positioned in close proximity to the end 22*a* wherein such end 22*a* has the resilient, bracelet-securing bracket 30. Preferably, the one end 1*a* of the clasping mechanism 1 overextends beyond to the end 22*a*.

Once the bracelet 5 is placed in the bracelet docking pad 32 and positioned accordingly, the resilient loop 44 is secured around the hooking implement 38 by pulling on the handle means 45. Thereby, one end 1*a* of the bracelet 5 is held securely to allow the user to use their free hand to hook the opposing end 1*b* of the bracelet together. In other words, the opposing end 1*b* of the clasping mechanism 1 of the bracelet 5 is brought around the wrist 2 until it reaches the secured one end 1*a* of the clasping mechanism 1 strapped in the bracelet docking pad 32. When the ends 1*a* and 1*b* of the clasping mechanism 1 are together, the clasping mechanism 1 can be easily clasped.

Once the bracelet 5 is clasped, the resilient loop 44 is unhooked from around the hooking implement 38 by pulling on the handle means 45 and lifting the resilient loop 44 from around the hooking implement 38. Thereafter, the bracelet fastening tool 10 is removed from the user's wrist 2.

As can be readily seen the bracelet fastening tool 10 of the present invention allows the user to quickly and easily clasp or couple together the free ends 1*a* and 1*b* of the bracelet 5 on their wrist 2 with little or not formation of scratches, nicks or other imperfections in the bracelet's surface.

Figure 3:
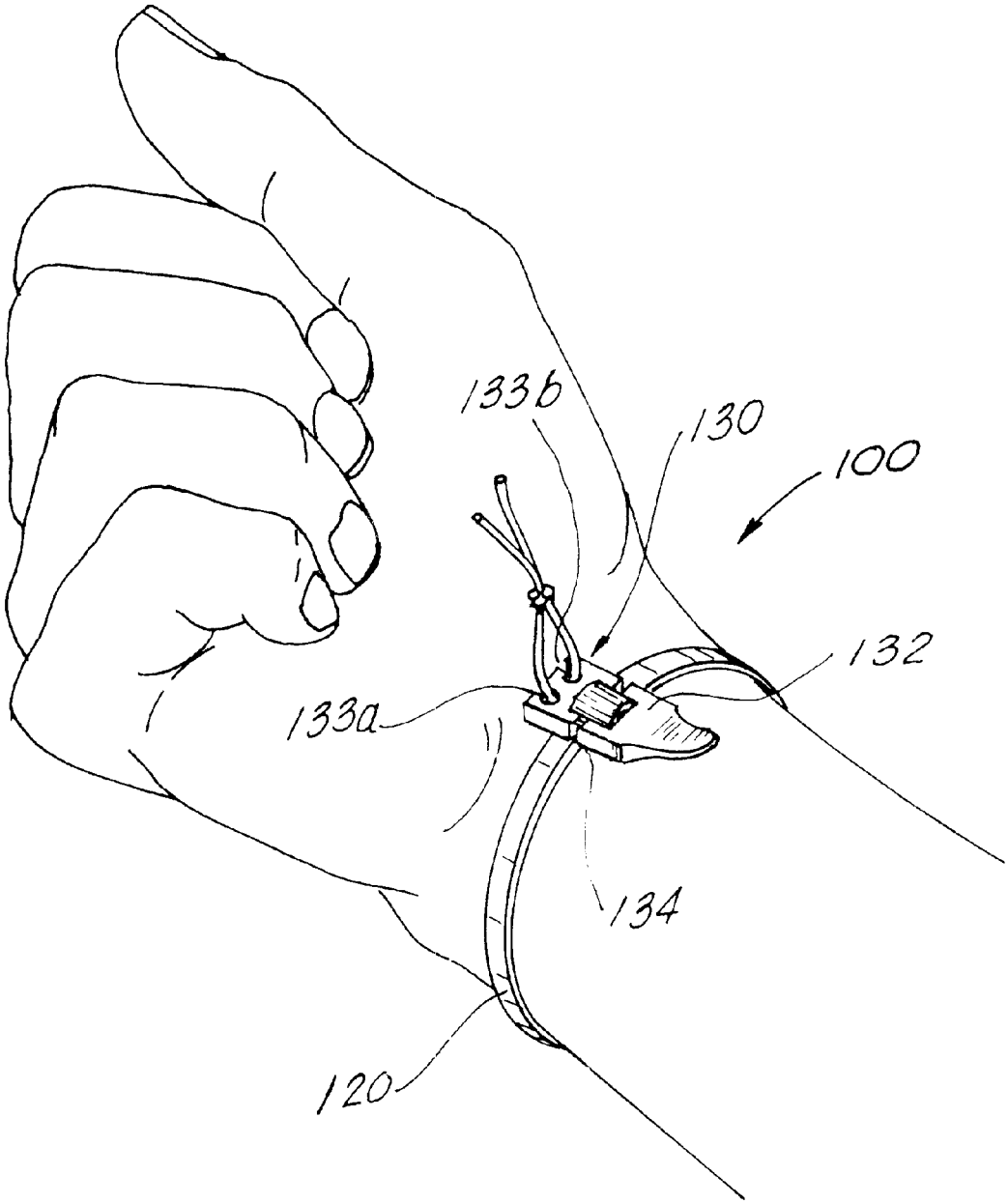

Referring now to FIG. 3, in the alternate embodiment, the bracelet fastening tool 100 includes an elastic band 120 having coupled thereon a resilient, bracelet-securing bracket 130. The resilient, bracelet-securing bracket 130 differs from the resilient, bracelet-securing bracket 30 in that the securing means 134 for securing the bracelet docking pad 132 to elastic band 120 includes two parallel slots 133*a* and 133*b* to thread or slip therethrough the elastic band 120.

In this embodiment, the bracelet docking pad 132 is padded with the elastic band 120.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A bracelet fastening tool comprising:

(a) a band which fits around the wrist of a user; and, (b) a resilient, bracelet-securing bracket coupled to the band wherein said resilient, bracelet-securing bracket comprises:

(i) a bracelet docking pad having a width which is wider than the width of the band wherein one side of the bracelet docking pad radiates from the band and tapers and arcs to form a hooking implement;

(ii) means for securing the bracelet docking pad to the band;

(iii) at least one hole formed in the other side of said bracelet docking pad; and, (iv) a resilient strapping member tied to said at least one hole and which is adapted to hook onto the hooking implement across the bracelet docking pad to secure the bracelet placed thereon.

2. The tool of claim 1, wherein said band comprises:

(i) an open-ended or C-shaped spring band made of a flexible metal and which is spring adjusted to accommodate for a variety of wrist sizes.

3. The tool of claim 1, wherein:

the bracelet docking pad includes a metal material;

the band includes a metal material; and, the securing means includes welding of said bracelet docking pad to said band.

4. The tool of claim 1, wherein the securing means includes:

(1) a U-shaped member affixed to the underside of the bracelet docking pad to form a channel guide dimensioned to receive or friction-fit couple therethrough the band.

5. The tool of claim 1, wherein said resilient strapping member includes:

(1) a loop secured to said at least one hole; and, (2) means for pulling said loop across said bracelet docking pad and over the hooking implement.

6. The tool of claim 1, wherein said band comprises an elastic band.

7. The tool of claim 6, wherein said securing means comprises:

(1) two parallel slots formed in said bracelet docking pad to thread or slip therethrough said elastic band wherein said elastic pad cushions said bracelet docking pad.

8. A bracelet fastening tool comprising:

(a) a C-shaped spring band, having two spaced apart and open ends, which fits around the wrist of a user; and, (b) a resilient, bracelet-securing bracket coupled to the band immediately adjacent to one end of said two spaced apart and open ends, said resilient, bracelet-securing bracket comprising:

(i) a bracelet docking pad having a width which is wider than the width of the band wherein one side of the bracelet docking pad radiates from the band and tapers and arcs to form a hooking implement;

(ii) means for securing the bracelet docking pad to the band;

(iii) at least one hole formed in the other side of said bracelet docking pad; and, (iv) a resilient strapping member tied to said at least one hole and which is adapted to hook onto the hooking implement across the bracelet docking pad to secure the bracelet placed thereon.

9. The tool of claim 8, wherein the open-ended or C-shaped spring band is made of a flexible metal and is spring adjusted to accommodate for a variety of wrist sizes.

10. The tool of claim 8, wherein the securing means includes:

(1) a U-shaped member affixed to the underside of the bracelet docking pad to form a channel guide dimensioned to receive or friction-fit couple therethrough the band.

11. The tool of claim 8, wherein:

the bracelet docking pad includes a metal material;

the band includes a metal material; and, the securing means includes welding of said bracelet docking pad to said band.

12. The tool of claim 8, wherein said resilient strapping member includes:

(1) a resilient loop secured to said at least one hole; and, (2) means for pulling said loop across said bracelet docking pad and over the hooking implement.

13. A method of fastening a bracelet with a bracelet fastening tool comprising a resilient, bracelet-securing bracket and an open-ended or C-shaped spring band, the method comprising the steps of:

(a) placing the open-ended or C-shaped spring band around a user's wrist, the band having two ends;

(b) overlaying the bracelet on top of the band;

(c) simultaneous with the step (b), placing one end of the bracelet in a bracelet docking pad of said resilient, bracelet-securing bracket;

(d) looping a resilient strap, of said resilient, bracelet-securing bracket, having a resilient loop over the bracelet and the bracelet docking pad and onto a hooking implement integrated with said bracelet docking pad; and, (e) with a free hand of the user, hooking an opposing end of the bracelet with said one end of the bracelet.

14. The method of claim 13, further comprising:

(f) after the step (e), unhooking the resilient loop from around the hooking implement.

15. The method of claim 14, wherein:

the step (d) includes the step of:

(d1n) pulling on a handle and stretching the resilient loop around the hooking implement; and, the step (f) includes the step of:

(f1) pulling on a handle and lifting the resilient loop from around the hooking implement.

16. The method of claim 15, wherein said bracelet docking pad has a width which is wider than a width of the band wherein one side of the bracelet docking pad radiates from the band and tapers and arcs to form said hooking implement; and wherein said resilient, bracelet-securing bracket further includes:

means for securing the bracelet docking pad to the band;

at least one hole formed in the other side of said bracelet docking pad wherein said resilient strap is tied to said at least one hole.

* * * * *